US012060689B1

(12) United States Patent
Oh

(10) Patent No.: US 12,060,689 B1
(45) Date of Patent: Aug. 13, 2024

(54) PROVISIONAL FACILITY FOR RETAINING EARTH BY USING GROUND ANCHORS AND GUIDE BRACKETS FOR STEPWISE RETENTION DURING DEEP EXCAVATION, AND METHOD FOR CONSTRUCTING SAME

(71) Applicant: Yong Hwan Oh, Seoul (KR)

(72) Inventor: Yong Hwan Oh, Seoul (KR)

( * ) Notice: Subject to any disclaimer, the term of this patent is extended or adjusted under 35 U.S.C. 154(b) by 0 days.

(21) Appl. No.: 18/696,508

(22) PCT Filed: May 25, 2023

(86) PCT No.: PCT/KR2023/007142
§ 371 (c)(1),
(2) Date: Mar. 28, 2024

(87) PCT Pub. No.: WO2024/053817
PCT Pub. Date: Mar. 14, 2024

(30) Foreign Application Priority Data

Sep. 7, 2022 (KR) ..... 10-2022-0113760

(51) Int. Cl.

| | |
|---|---|
| ***E02D 17/04*** | (2006.01) |
| ***E02D 5/04*** | (2006.01) |
| ***E02D 5/28*** | (2006.01) |
| ***E02D 17/08*** | (2006.01) |

(52) U.S. Cl.
CPC ..... *E02D 17/04* (2013.01); *E02D 5/04* (2013.01); *E02D 5/28* (2013.01); *E02D 17/083* (2013.01); *E02D 2300/0029* (2013.01); *E02D 2600/20* (2013.01); *E02D 2600/30* (2013.01)

(58) Field of Classification Search
CPC .. E02D 17/04; E02D 5/04; E02D 5/28; E02D 17/083; E02D 2300/0029; E02D 2600/20; E02D 2600/30
See application file for complete search history.

(56) References Cited

FOREIGN PATENT DOCUMENTS

| | | | | |
|---|---|---|---|---|
| JP | 2009-185556 | A | | 8/2009 |
| JP | 2013136921 | A | * | 7/2013 |
| KR | 10-0941669 | B1 | | 2/2010 |
| KR | 101036173 | B1 | * | 5/2011 |
| KR | 10-1062179 | B1 | | 9/2011 |
| KR | 10-1498711 | B1 | | 3/2015 |
| KR | 20150088406 | A | * | 8/2015 |
| KR | 20180060852 | A | * | 6/2018 |
| KR | 10-2018-0092499 | A | | 8/2018 |
| KR | 10-2002059 | B1 | | 7/2019 |
| KR | 10-2079720 | B1 | | 2/2020 |
| KR | 102315422 | B1 | * | 10/2021 |

* cited by examiner

*Primary Examiner* — Kyle Armstrong
(74) *Attorney, Agent, or Firm* — The PL Law Group, PLLC

(57) ABSTRACT

A provisional facility for retaining earth using a guide bracket and a ground anchor for stepwise retention during deep excavation includes multiple thumb piles disposed vertically at predetermined intervals, a wale disposed across the multiple thumb piles, a guide bracket installed at a predetermined position of the wale, and a ground anchor having the other side anchored to a ground while a tensile member is wound around the guide bracket.

7 Claims, 10 Drawing Sheets

PROVISIONAL FACILITY FOR RETAINING EARTH BY USING GROUND ANCHORS AND GUIDE BRACKETS FOR STEPWISE RETENTION DURING DEEP EXCAVATION, AND METHOD FOR CONSTRUCTING SAME

CROSS REFERENCE TO RELATED APPLICATION AND CLAIM OF PRIORITY

This application claims benefit under 35 U.S.C. 119, 120, 121, or 365 (c), and is a National Stage entry from International Application No. PCT/KR2023/007142, filed May 25, 2023, which claims priority to the benefit of Korean Patent Application No. 10-2022-0113760 filed in the Korean Intellectual Property Office on Sep. 7, 2022, the entire contents of which are incorporated herein by reference.

BACKGROUND

1. Technical Field

The present invention relates to a provisional facility for retaining earth by using ground anchors and guide brackets for stepwise retention during deep excavation, and a method for constructing same, and more particularly, to a provisional facility for retaining earth by using ground anchors and guide brackets for stepwise retention during deep excavation, in which H-piles are installed before excavation, vertical ground anchors are installed between the H-piles, wales are installed such that guide brackets can be installed in excavation height positions in which stepwise retention is necessary, guide brackets are installed on the middle portion of the wales such that, by using the fixing force from vertical ground anchors installed before excavation, the support force from the vertical ground anchors can be converted into a horizontal tensile force, ground anchor tensile members are induced/installed on the guide brackets and are fixed at the middle portion of the wales, the tensile members are then tensioned such that the load acting on the back surface of the wales is transferred to the H-piles through the wales, thereby acting as a support force, the H-piles thus play the retention role by means of the load acting on the back surface of the wales without installing separate retention members (for example, struts, rakers) on the ground excavation site, and multiple steps of retention can be supported without occupying other sites on the excavation back side even in a small space (wherein the back site is 1 m or less) in the case of downtown deep excavation, thereby making the ground excavation operation safe, low-cost, and easy, and a method for constructing same.

2. Background Art

For the construction of underground structures, earth retaining structures are installed to surround a work area, and various construction methods such as thumb pile earth walls, diaphragm walls, sheet piles, and C. I. P. are being applied.

Such a conventional earth retaining method has the following problems.

When carrying out an excavation work, a retaining wall alone may not resist an earth pressure of the background soil, and thus, a large number of retention materials (struts, earth anchors, rakers, etc.) has to be used to reinforce the resistance to the earth pressure.

However, the above-described earth anchor method may involve anchoring an earth anchor by 10 M or more into an adjacent site, but when the use of the adjacent site is restricted, a strut or raker method has no choice but to be applied every 2.5 mm of an excavation height, which is greatly disadvantageous in terms of economic feasibility and construction conditions.

In addition, in the conventional construction method using support struts and anchor holes, the support struts and anchor holes are tightly installed at intervals of 2 m to 3 m in a vertical direction of the excavation to cause inconvenience in use of heavy equipment due to a narrow work space, and also, when the anchors are used, it is difficult to use the heavy equipment in excavation in urban areas due to invasion of the private land, damage to existing structures, and an inflow of nearby groundwater.

SUMMARY

Accordingly, the present invention has been devised to solve the problems described above, and the purpose of the present invention is to provide a provisional facility for retaining earth by using ground anchors and guide brackets for stepwise retention during deep excavation, and a method for constructing same, wherein H-piles are installed before excavation, vertical ground anchors are installed between the H-piles, wales are installed such that guide brackets can be installed in excavation height positions in which excavation stepwise retention is necessary, guide brackets are installed on the middle portion of the wales such that, by using the fixing force from vertical ground anchors installed before excavation, the support force from the vertical ground anchors can be converted into a horizontal tensile force, ground anchor tensile members are induced/installed on the guide brackets and are fixed at the middle portion of the wales, the tensile members are then tensioned such that the load acting on the back surface of the wales is transferred to the H-piles through the wales, thereby acting as a support force, the H-piles thus play the retention role by means of the load acting on the back surface of the wales without installing separate retention members (for example, struts, rakers) on the ground excavation site, and multiple steps of retention can be supported without occupying other sites on the excavation back side even in a small space (wherein the back site is 1 m or less) in the case of downtown deep excavation, thereby making the ground excavation operation safe, low-cost, and easy.

In order to accomplish the above-mentioned purpose, a provisional facility for retaining earth by using ground anchors and guide brackets for stepwise retention during deep excavation according to the present invention are characterized in that ground anchors capable of multiple steps of retention in the vertical direction are installed between multiple H-piles disposed vertically at a predetermined interval, wales are installed such that guide brackets can be installed in excavation height positions in which excavation stepwise retention is necessary, guide brackets are installed on the middle portion of the wales such that, by using the fixing force from vertical ground anchors installed before excavation, the support force from the vertical ground anchors can be converted into a horizontal tensile force, ground anchor tensile members are induced/installed on the guide brackets, and the tensile members are then tensioned such that the load acting on the back surface of the wales is transferred to the H-piles through the wales, thereby acting as a support force.

In addition, in order to accomplish the above-mentioned purpose, a method for constructing a provisional facility for retaining earth by using ground anchors and guide brackets for stepwise retention during deep excavation according to the present invention is a method for constructing a provisional facility for retaining earth by using ground anchors and guide brackets for stepwise retention during deep excavation, configured such that ground anchors capable of multiple steps of retention in the vertical direction are installed between multiple H-piles disposed vertically at a predetermined interval, wales are installed such that guide brackets can be installed in excavation height positions in which excavation stepwise retention is necessary, guide brackets are installed on the middle portion of the wales such that, by using the fixing force from vertical ground anchors installed before excavation, the support force from the vertical ground anchors can be converted into a horizontal tensile force, ground anchor tensile members are induced/installed on the guide brackets, and the tensile members are then tensioned such that the load acting on the back surface of the wales is transferred to the H-piles through the wales, thereby acting as a support force, the method comprising the steps of: forming multiple bored holes by excavating the ground with a predetermined diameter and to a predetermined depth; installing H-piles in the bored holes; installing multiple vertical ground anchors on wale rear portions between the installed H-piles; installing wales having guide brackets across the H-piles with regard to each excavation step; fixing tensile members installed on the ground anchors to the guide brackets; and tensioning the tensile members with a predetermined tension such that the middle portion of the wales is endowed with a load to the back-side ground, wherein the retention force is maintained by using the multiple vertical ground anchors installed with regard to each deep excavation retention step.

As described above, the provisional facility for retaining the earth by using the ground anchors and the guide brackets for the stepwise retention during the deep excavation and the method for constructing the same may have the following effects.

First, the present invention may have the advantage that the guide bracket is installed on the wale, and the tensile member of the ground anchor is installed on the guide bracket and anchored at the middle portion of the wale, and then, the tensile member is tensioned to apply the back-side load of the thumb pile to the middle portion of the wale, thereby prevent the thumb pile from falling or collapsing into the excavation space without installing the separate retention member at the excavation side.

Second, the present invention may have the effect of the allowing the construction of the earth retaining facility regardless of the narrowness of the ground site at the back side of the thumb pile even in the narrow space in the city center, regardless of before or after the excavation.

Third, in the present invention, the ground anchor may be installed at the deeper depth than the thumb pile, and the tensile member coupled to the ground anchor may tension the middle portion of the wales to be tensioned to the outside of the excavation space, thereby preventing the thumb pile from falling or collapsing into the excavation space.

Fourth, the present invention may solve the earth retaining structure by installing the multiple steps even at the excavation depth that requires the multiple steps of retention of the deeper excavation.

Fifth, the present invention may have the advantage of minimizing the installation of the retention materials or the wales at the excavation side to greatly improve the construction cost and short the construction period, thereby easily securing the work space and improving the workability.

DETAILED DESCRIPTION

Hereinafter, the present invention will be described in detail with reference to the attached illustration drawings.

[Provisional Facility for Retaining Earth Using Guide Bracket and Ground Anchor for Stepwise Retention During Deep Excavation]

Figure 1:
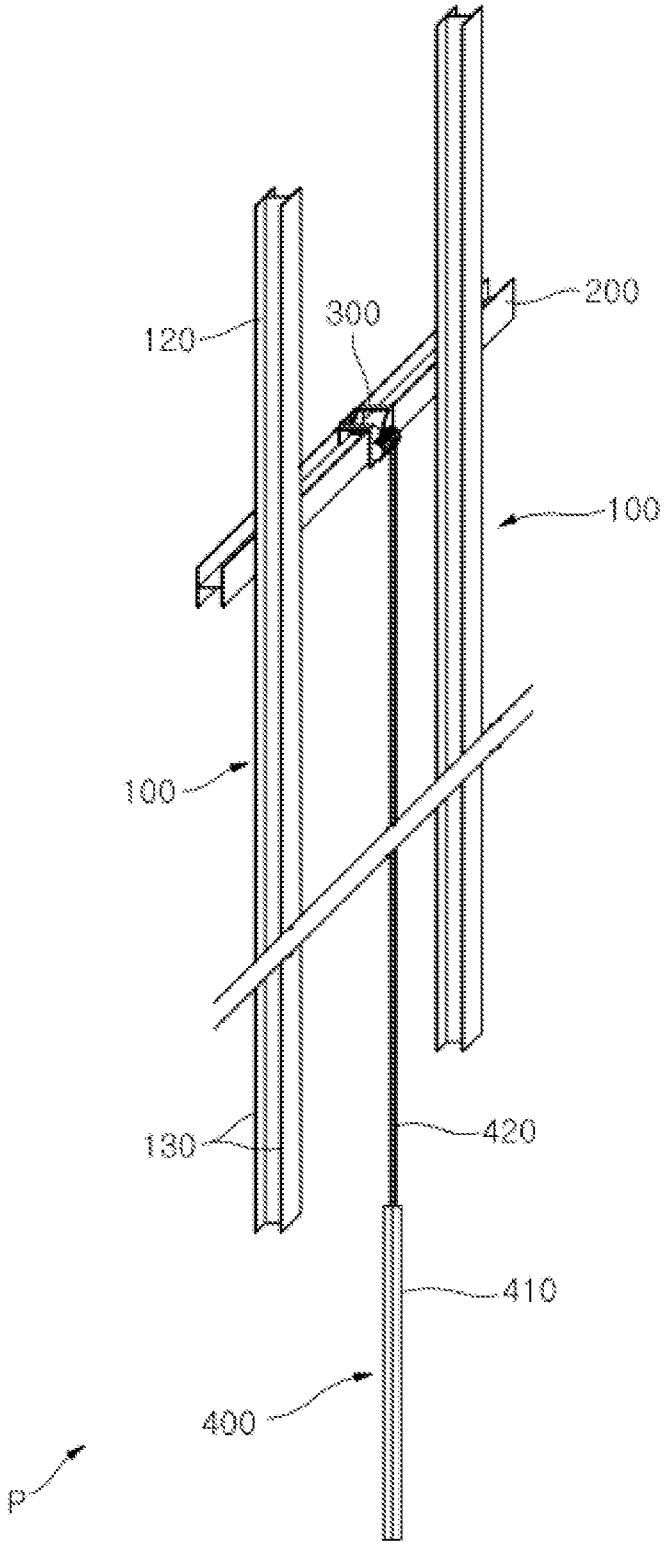
FIG. 1 is a perspective view illustrating a provisional facility for retaining earth using a guide bracket and a ground anchor for stepwise retention during deep excavation according to the present invention.
Figure 2:
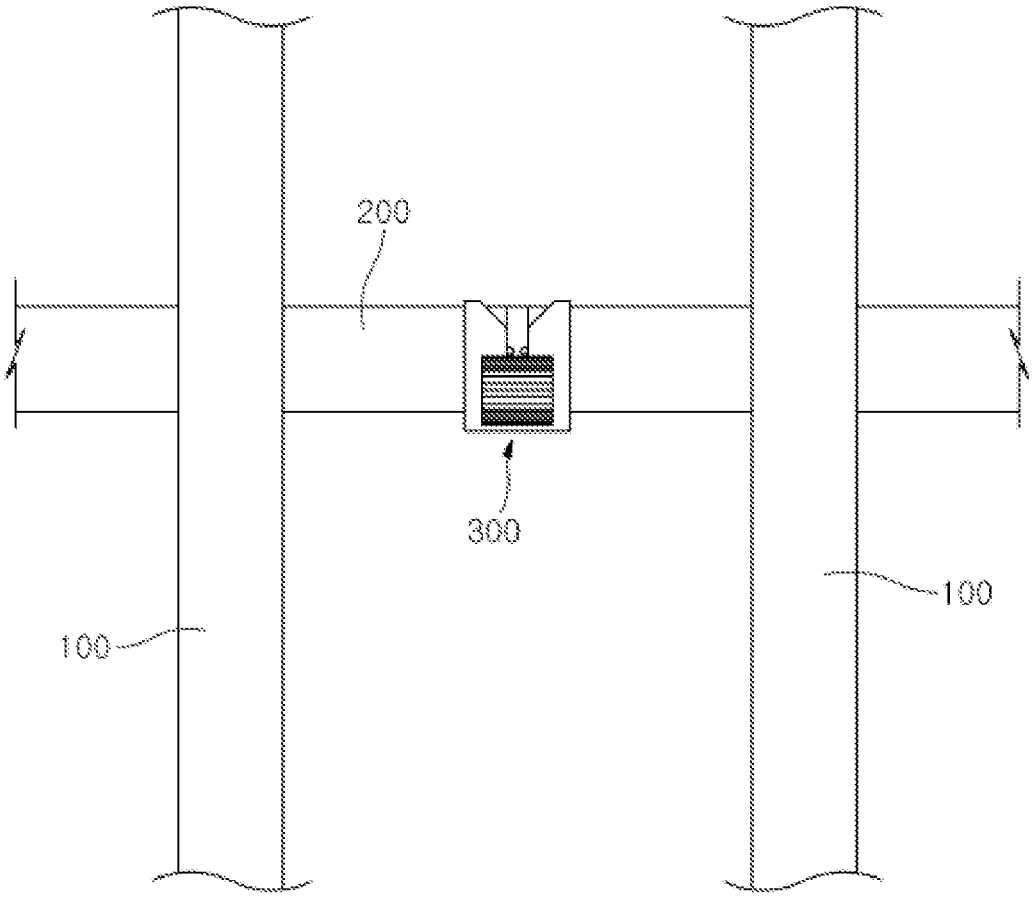
FIG. 2 is a front view illustrating the provisional facility for the retaining earth using the guide bracket and the ground anchor for the stepwise retention during the deep excavation according to the present invention.
Figure 3:
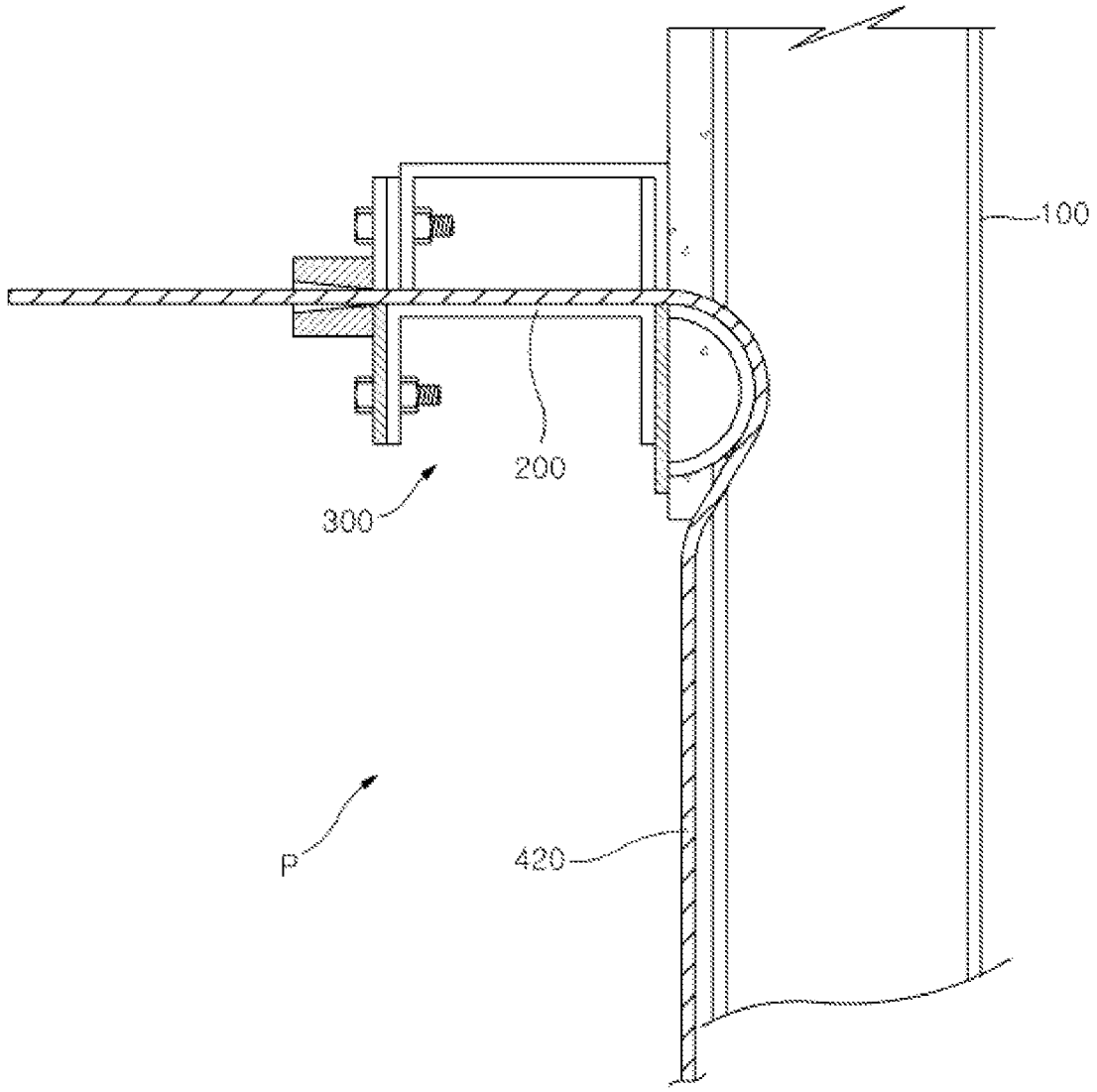
FIG. 3 is a cross-sectional view illustrating the provisional facility for the retaining earth using the guide bracket and the ground anchor for the stepwise retention during the deep excavation according to the present invention.
Figure 4:
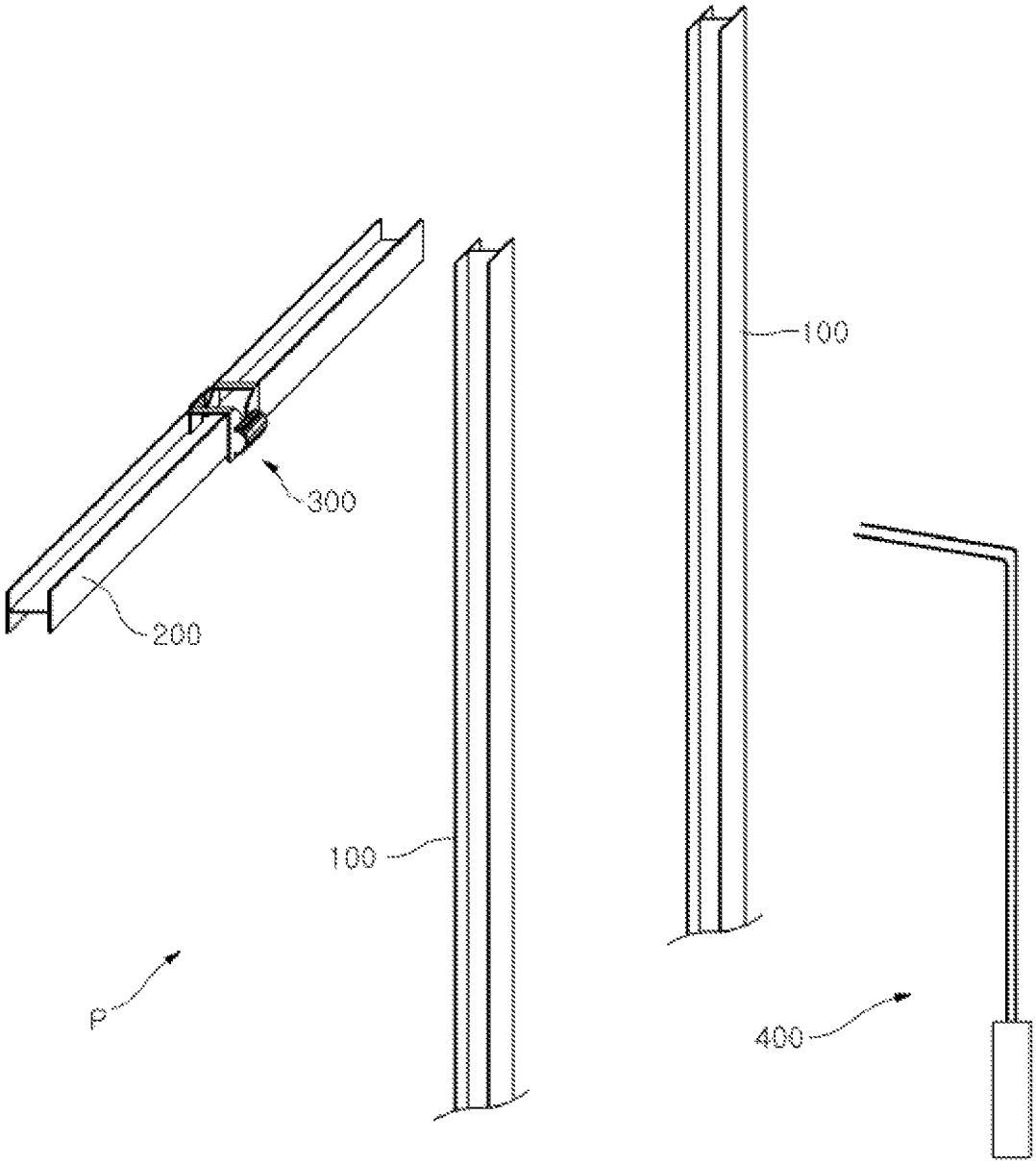
FIG. 4 is a perspective view illustrating the provisional facility for the retaining earth using the guide bracket and the ground anchor for the stepwise retention during the deep excavation according to the present invention.
Figure 5:
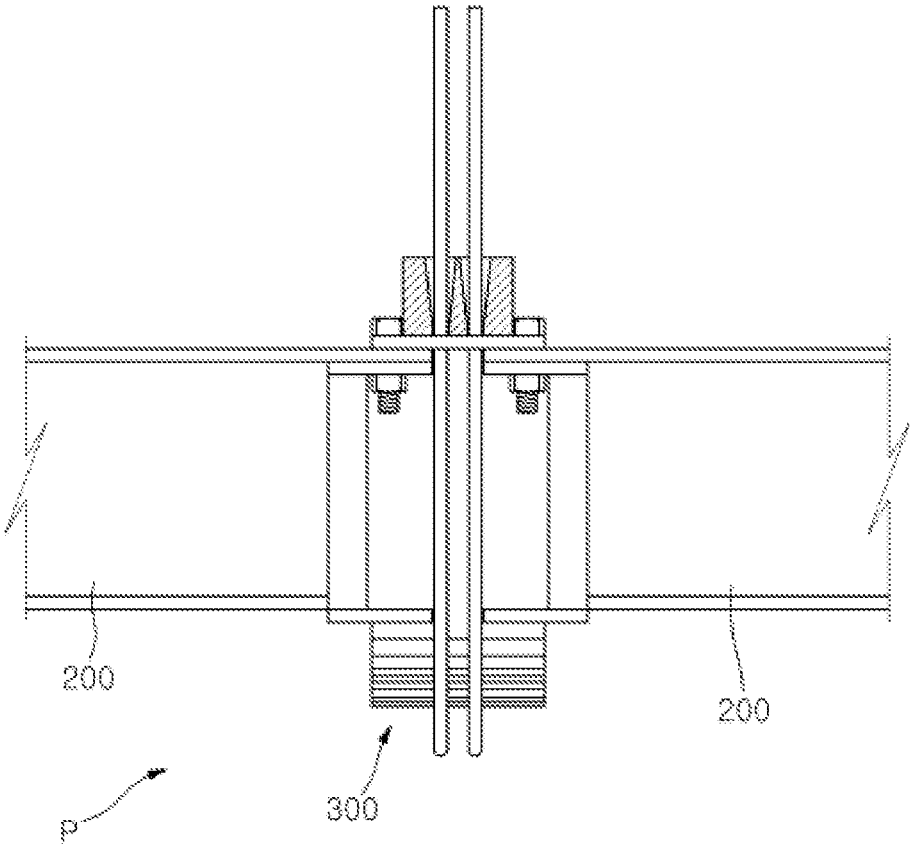
FIG. 5 is a plan view illustrating a provisional facility for retaining earth using a guide bracket and a ground anchor according to the present invention.
Figure 6:
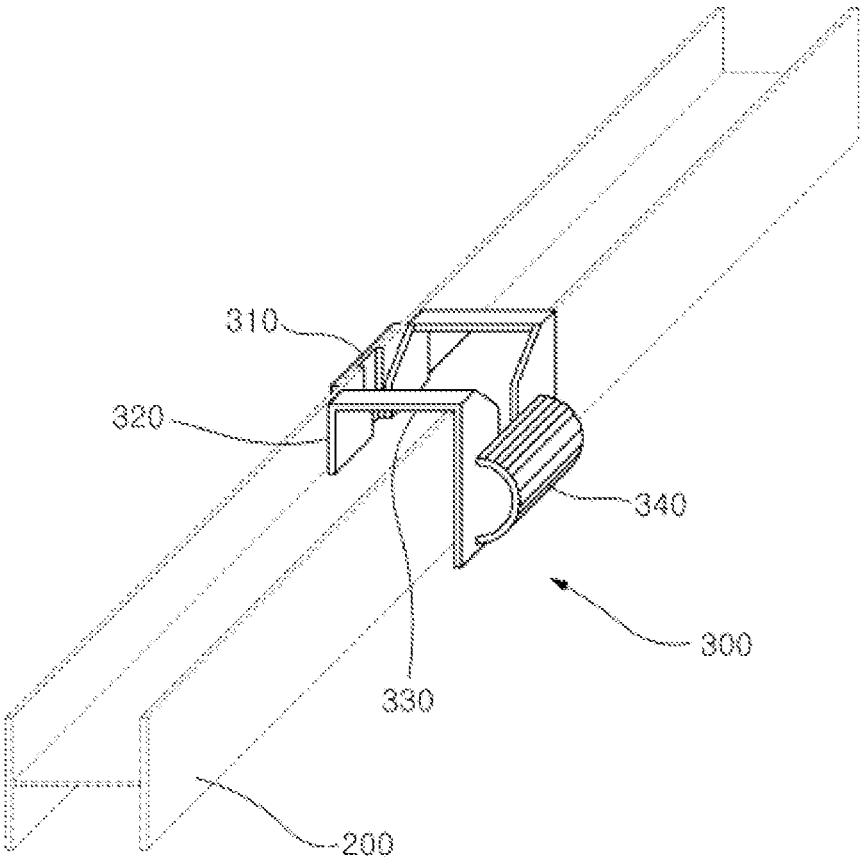
FIG. 6 is a perspective view illustrating a guide bracket of the provisional facility for the retaining earth using the guide bracket and the ground anchor for stepwise retention during deep excavation according to the present invention.
Figure 7:
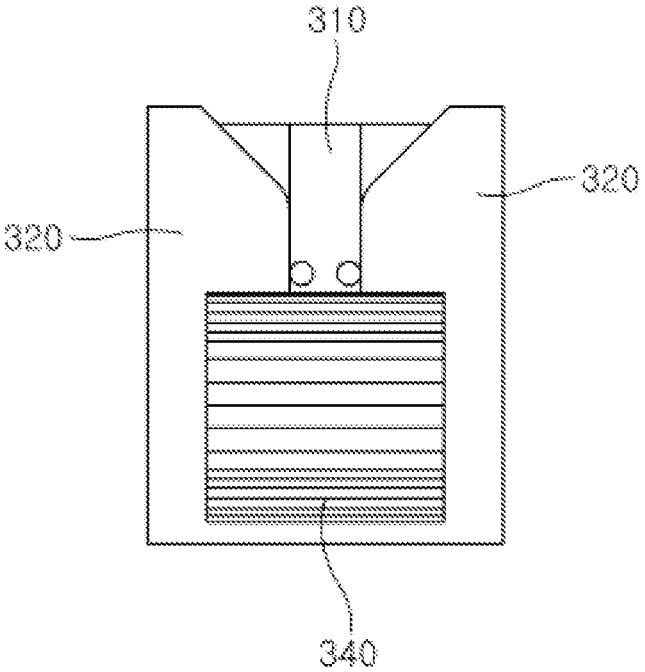
FIG. 7 is a front view illustrating the guide bracket of the provisional facility for the retaining earth using the guide bracket and the ground anchor for the stepwise retention during the deep excavation according to the present invention.
Figure 8:
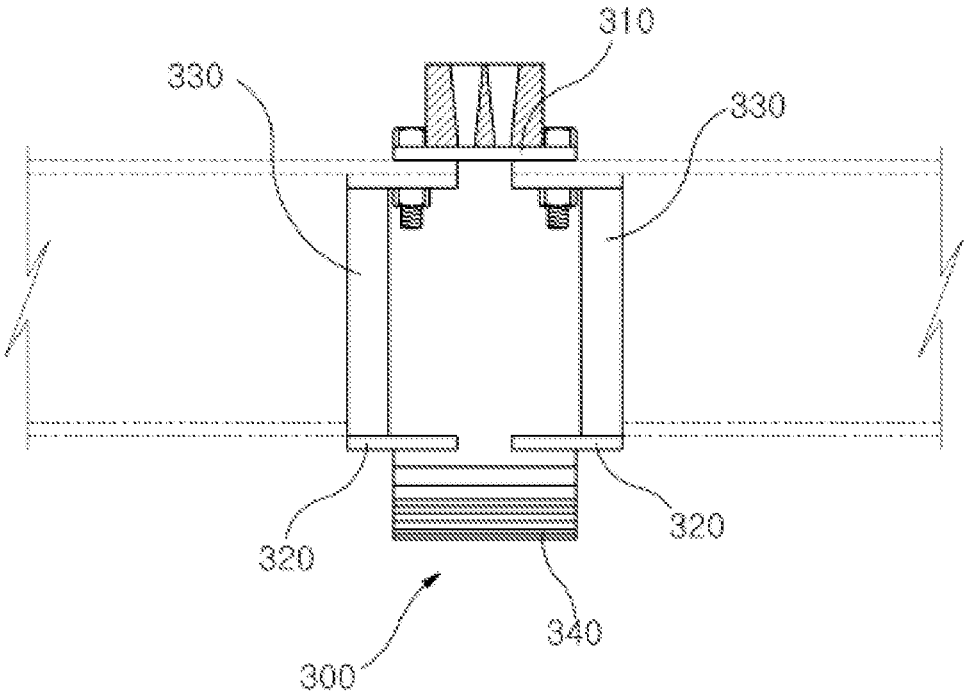
FIG. 8 is a plan view illustrating the guide bracket of the provisional facility for the retaining earth using the guide bracket and the ground anchor for the stepwise retention during the deep excavation according to the present invention.
Figure 9:
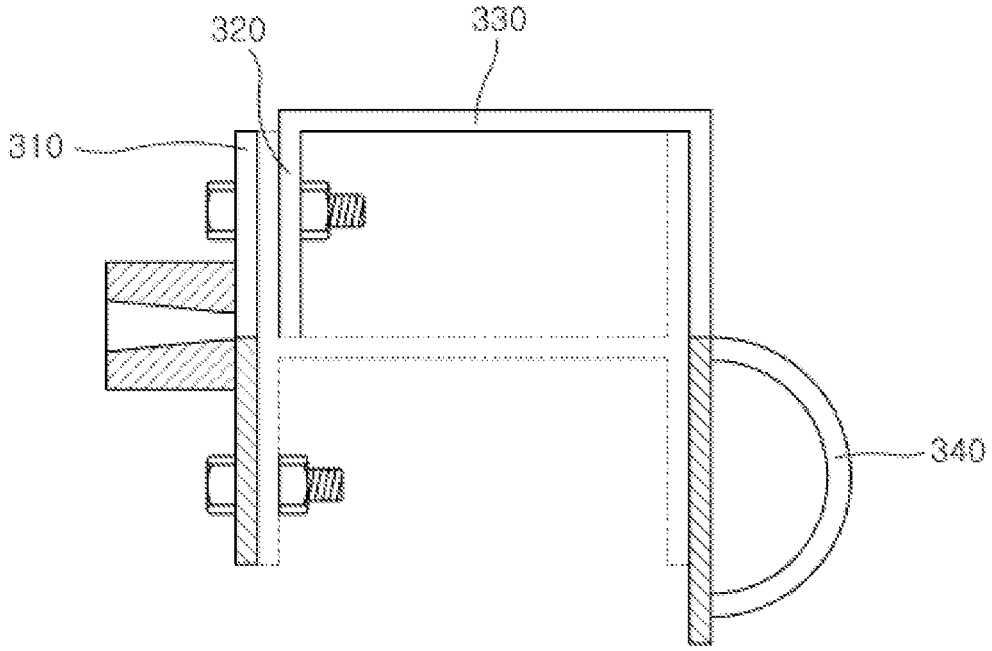
FIG. 9 is a side view illustrating the guide bracket of the provisional facility for the retaining earth using the guide bracket and the ground anchor for the stepwise retention during excavation according to the the deep present invention.

FIG. 1 is a perspective view illustrating a provisional facility for retaining earth using a guide bracket and a ground anchor for stepwise retention during deep excavation according to the present invention, FIG. 2 is a front view illustrating the provisional facility for the retaining earth using the guide bracket and the ground anchor for the stepwise retention during the deep excavation according to the present invention, FIG. 3 is a cross-sectional view illustrating the provisional facility for the retaining earth using the guide bracket and the ground anchor for the stepwise retention during the deep excavation according to the present invention, FIG. 4 is a perspective view illustrating the provisional facility for the retaining earth using the guide bracket and the ground anchor for the stepwise retention during the deep excavation according to the present invention, and FIG. 5 is a plan view illustrating a provisional facility for retaining earth using a guide bracket and a ground anchor according to the present invention.

As shown in the drawings, a provisional facility P for retaining earth using a guide bracket and a ground anchor for stepwise retention during deep excavation according to the present invention includes: multiple thumb piles 100 disposed vertically at predetermined intervals; a wale 200 disposed across the multiple thumb piles 100; a guide bracket 300 disposed at a predetermined position of the wale 200; and a ground anchor 400 having the other side anchored to the ground G while a tensile member 420 is wound around the guide bracket 300.

That is, the provisional facility P for retaining the earth using the guide bracket and the ground anchor for the stepwise retention due to the deep excavation according to the present invention is a structure in which the thumb piles 100, the wale 200, the guide bracket 300, and the ground anchor 400 are organically coupled to each other.

Here, each of the thumb piles 100 and the wale 200 may be provided as any one of a section steel, an H-section steel, an I-section steel, a ⊏-section steel, a ¬-section steel, a steel pipe, a hollow pipe, a circular steel pipe, a square pipe, and a section steel.

In particular, the section steel is a general term for long steel pre-molded into a certain cross-sectional shape such as an H-type or an L-type and is mainly used in civil engineering, architectural columns or beams, foundation piles, mechanical products, etc. There are various section steels depending on the shape of the cross-section, and it is used adequately according to epidemiological rationality and purpose of use.

In addition, the H-section steel is a section steel having an H-shaped cross-section that is widely used in a framework of large structures such as buildings and ships or in the civil engineering work and is made by hot rolling.

Here, a portion corresponding to a horizontal bar at a center of the H-section steel is called a web, and portions corresponding to vertical bars at both sides are called upper and lower flanges. The upper and lower flanges, each of which has a size of 300 mm or less, are called a junior size, and the upper and lower flanges, each of which has a size of 300 mm or more, are called a senior size.

In addition, there is an I-section steel having a cross-section similar to the H-section steel. The H-section steel is different from the I-section steel in that a thickness of each of the upper and lower flanges is constant up to an end thereof, ends of the upper and lower flanges are not rounded, and a width of the I-beam is less than a height thereof, but the H-section steel has a width and a height, which are the same.

One having the wide width is called a wide flange H-section steel, and its overall cross-section has a square shape and thus is easy to be used as a building pillar.

The specifications are specified in KS D 3503, and the shape and dimensions are specified in KS D 3051.

The steel pipe is a construction material made of an alloy of iron and carbon and means that the cross-section is a circular pipe or a hollow square pipe. It should be noted that square pipes and pipes having various shapes are used as necessary.

In particular, it should be noted that no special technical requirements are required when exclusively using the circular pipe as a variety of pipes such as square pipes and closed bend pipes.

In addition, the guide bracket 300 includes: a support plate 310 having a certain thickness and width; a vertical plate 320 extending at a right angle from each of both ends of the support plate 310; a horizontal plate 330 extending at a right angle to the vertical plate 320; and a semicircular fixed pulley 340 coupled between the vertical plates 320.

That is, the guide bracket 300 is provided by bending multiple steel plates 310, 320, and 330 vertically and horizontally, and the semicircular fixed pulley 340 is installed on the bracket.

Here, the tensile member 420 is caught on the semicircular fixed pulley 340 to passes between the vertical plates 320, and the angle of the tensile member 420 is changed from the vertical state to the horizontal state by the semicircular fixed pulley 340 to extend to a side surface of the wale 200.

In addition, the ground anchor 400 includes: an anchor body 410 having a certain weight disposed at a lower end thereof; and a tensile member 420 having one side embedded into the anchor body 410 and the other side drawn to a certain length.

That is, the ground anchor 400 has a structure in which the anchor body 410 and the tensile member 420 are organically coupled to each other.

Here, the anchor body 410 is disposed at the lowermost end and is a structure having a certain weight.

In addition, the tensile member 420 is fixed to the guide bracket 300, and the other side of the tensile member 420 is fixed to the anchor body 410 fixed to the ground G.

The ground anchor 400 is installed vertically or inclined on the ground G on a rear side of the thumb pile 100 at an opposite side of the thumb pile 100.

Here, an upper free length portion of the tensile member 420 to be fixed to the guide bracket 300 defines a bored position accurately when boring vertically an initial ground anchor 400 so that an upper portion of the tensile member 420 is easily exposed when excavated at an installation height of the wale 200 by using excavation equipment, and the tensile member 420 to be fixed to the guide bracket 300 for each stage of excavation is divided to be installed in an unbonded form that is colored for easy identification so as to be fixed to the wale 200 and the guide bracket 300 for each stage of excavation, thereby providing a retention during construction the deep excavation.

The inclination angle of the ground anchor 400 is maintained at an angle (0° to 20°) that does not exceed a site boundary based on an angle of 0°.

A lower portion of the above-mentioned ground anchor 400 is anchored to the anchor body 410 in a state in which tension force is applied to the tensile member 420, and an upper portion of the ground anchor 400 is anchored to the middle portion of the wale 200 through the guide bracket 300.

Here, a straight ground action line L of about 20° to 45° at a depth of an excavation area may be assumed in the ground G around the excavation area on which the ground anchor 400 is installed. The ground anchor 400 of the ground anchor 400 is installed at a position (stable area) deeper than the ground action line L.

Thus, the tension of the ground anchor 400 may be stably exerted.

In addition, the ground anchor 400 to which the tension is applied is tilted at a predetermined angle of 0° to 20° from the ground at the rear side of the thumb pile 100 toward the thumb pile 100 or is stretched upward in a vertical state and is bent at an obtuse angle, for example, an angle of 90° to 110° from the semicircular fixed pulley 340 to extend toward the middle portion of the wale 200.

Here, the ground anchor 400 takes vertical reaction force and horizontal reaction force from the ground G through the guide bracket 300 to apply the horizontal force to the middle portion of the wale 200.

As a result, a load in a direction in which the thumb pile 100 falls to the back ground G acts on the thumb pile 100, and thus, moment and deformation in a direction in which the thumb pile 100 falls into the excavation area are alleviated to prevent the thumb pile 100 from falling toward the excavation area.

In the provisional facility P for retaining the earth using the guide bracket and the ground anchor for the stepwise retention during the deep excavation according to the present invention, which is configured as described above, the ground anchor 400 is installed on the ground G at the back side of the thumb pile 100, the wale 200 is installed on the thumb pile 100, the guide bracket 300 is installed on the wale 200, and after installing the tensile member 420 of the ground anchor 400 on the guide bracket 300, the tensile member 420 is tensioned to apply a load to the rear side of the thumb pile 100 at the middle portion of the wale 200, and thus, even without installing a separate retention material at the excavation side, there is no concern that the thumb pile 100 falls or collapses into the excavation space, and even in narrow spaces in urban areas, the excavation work is carried out safely and easily at a low cost.

[Method for Constructing Provisional Facility for Retaining Earth]

Figure 10:
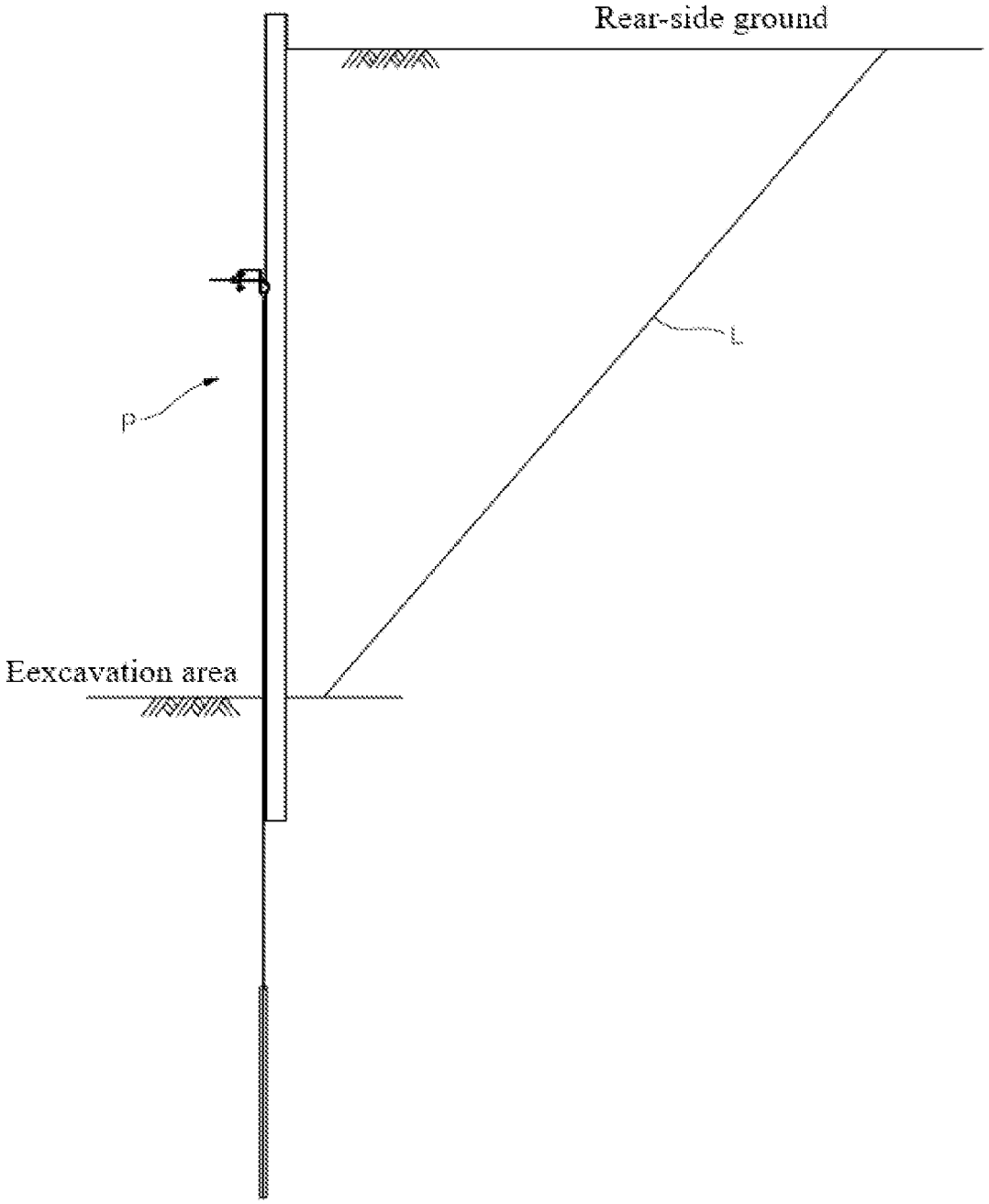
FIG. 10 is a construction view illustrating a state of constructing the provisional facility for the retaining earth using the guide bracket and the ground anchor for the stepwise retention during the deep excavation.
Figure 11:
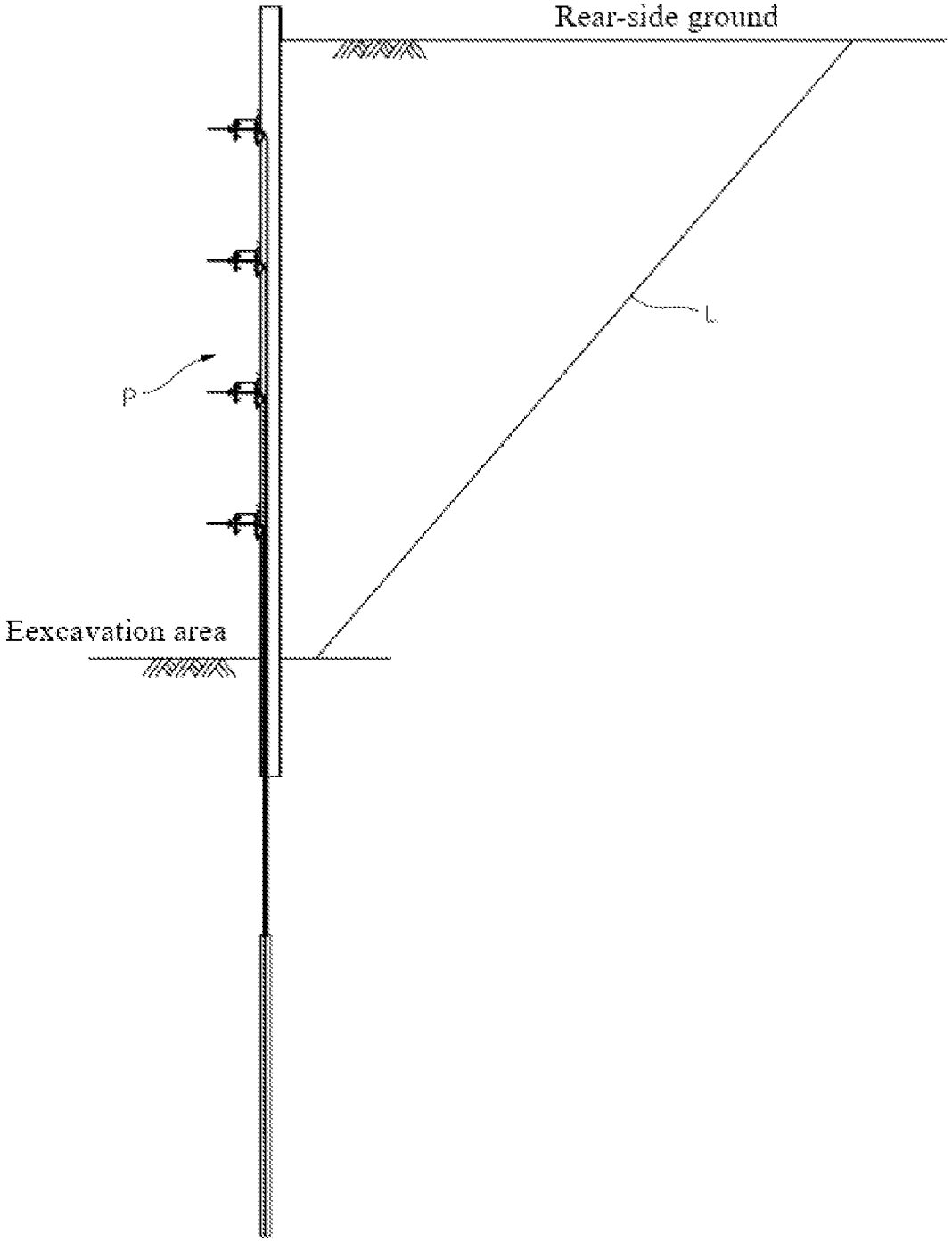
FIG. 11 is a construction view illustrating a state of constructing the provisional facility for the retaining earth using the guide bracket and the ground anchor for the stepwise retention during the deep excavation in multiple steps of retention according to the present invention.

FIG. 10 is a construction view illustrating a state of constructing the provisional facility for the retaining earth using the guide bracket and the ground anchor for the stepwise retention during the deep excavation, and FIG. 11 is a construction view illustrating a state of constructing the provisional facility for the retaining earth using the guide bracket and the ground anchor for the stepwise retention during the deep excavation in multiple steps of retention according to the present invention.

As shown in the drawings, a method for constructing a provisional facility for retaining earth by using a ground anchor and a guide bracket for stepwise retention during deep excavation is a method for constructing the provisional facility for retaining earth by using the provisional facility P for retaining the earth by using the ground anchor and the guide bracket for the stepwise retention during the deep excavation, which is constituted by multiple thumb disposed piles 100 vertically at predetermined intervals; a wale 200 disposed across the multiple thumb piles 100; a guide bracket 300 installed at a predetermined position on the wale 200; and a ground anchor 400 of which the other side is anchored to ground G while a tensile member 420 is wound around the guide bracket 300, the method includes: forming multiple bored holes by excavating the ground at a predetermined diameter and a predetermined depth; installing the thumb piles 100 in the bored holes; installing multiple vertical ground anchors on a rear surface of the wale 200 between the installed thumb piles 100; installing the wale 200 to which the guide bracket 300 is attached to the thumb piles 100 across the thumb piles 100; fixing the tensile member 420 installed on the ground anchor to the guide brackets 300; and tensioning the tensile member 420 at a predetermined tension to apply a load to a rear-side ground to a middle portion of the wale 200, wherein the above processes are repeatedly performed to form a retention structure for deep excavation.

That is, the method for constructing the provisional facility for retaining earth by using the ground anchor and the guide bracket for the stepwise retention during the deep excavation includes: excavating the ground G to a certain diameter and depth using an excavator such as an auger to form multiple bore holes; installing the thumb piles 100 in the bored holes; installing a vertical ground anchor on a rear surface of the wale 200 between the installed thumb piles 100; installing the wale 200 to which the guide bracket 300 is attached to the thumb piles 100 across the thumb piles 100; fixing the tensile member 420 installed on the ground anchor to the guide brackets 300; and tensioning the tensile member 420 at a predetermined tension to apply a load to a rear-side ground to a middle portion of the wale 200, wherein the wale 200, to which the guide bracket 300 for stepwise retention during deep excavation is attached, is installed, the tensile member 420 installed on the multiple ground anchors 400 is fixed to the guide bracket 300, the tensile member 420 is tensioned constantly to transfer a load transferred to the wale 200 to the thumb piles 100 so as to serve as the retention, and the load is applied to the excavation rear surface ground side, wherein the above processes are repeatedly performed to form the retention structure for deep excavation.

Here, the ground anchor 400 is installed in the ground G at a depth that ensures anchoring force in the vertical area within the site behind the excavation.

Next, the guide bracket 300 is installed on the wale 200 on an outer circumference of the excavation area.

Next, the tensile member 420 of the ground anchor 400 is hung on the semicircular fixed pulley 340 of the guide bracket 300, the semicircular fixed pulley 340 is fixed, and the tensile member 420 is anchored to the middle portion of the wale 200 by the anchor in the state of applying tensile force.

That is, the tensile member 420 of the ground anchor 400 fixed to the middle portion of the wale 200 is changed to a horizontal state on the semicircular fixed pulley 340 of the guide bracket 300 installed on the wale 200.

As a result, it is possible to install the ground anchor 400 to a deep position in the ground G after suppressing a horizontal distance from the wale 200.

Therefore, regardless of the narrowness of the ground G on the rear side of the thumb pile 100, horizontal force is applied to the middle portion of the wale 200 so that the ground anchor 400 that prevents the thumb pile 100 from falling into the excavation area of the thumb pile 100 may be installed.

In addition, the tensile member 420 of the ground anchor 400 for connecting the ground anchor 400 to the middle portion of the wale 200 is installed on the guide bracket 300 installed at the middle portion of the wale 200, and thus, there is no need to expose a surface of the thumb pile 100.

Therefore, the ground anchor 400 may be installed regardless of whether before or after the excavation is performed in the excavation area.

In addition, as described above, the ground anchor 400 may be inclined to an opposite side of the thumb pile 100 or may be vertical, or the thumb pile 100 itself may be inclined.

The wale 200 is provided in several stages as the excavation depth increases, and as the number of stages of the wale 200 increases, anchorage of the ground anchor 400 has to increase, and thus a diameter and anchoring length of the bore hole have to increase and also become longer.

In the method for constructing the provisional facility for retaining earth by using the ground anchor and the guide bracket for the stepwise retention during the deep excavation, which includes the above-described processes, the ground G may be excavated to a certain diameter and depth to form the multiple bore holes, the thumb piles 100 may be inserted into the bored holes, the vertical ground anchor on the rear surface of the wale 200 may be installed between the installed thumb piles 100 to form anchoring force, the wale 200 to which the guide bracket 300 is attached to the thumb piles 100 may be installed across the thumb piles 100 at a retention height for each stage of excavation, the tensile member 420 installed on the ground anchor may be fixed to the guide brackets 300, the tensile member 420 may be tensioned at a predetermined tension to apply the transfer load of the wale 200 to the thumb piles 100 to serve as retention, the wale 200 to which the guide bracket 300 is attached for each stage of the deep excavation is installed, the tensile members 420 installed on the multiple ground anchors 400 are fixed to the guide bracket 300, and the tensile member 420 is tensioned at a certain tension to apply the load to the rear-side ground at the middle portion of the wale 200, wherein the above-described processes are repeatedly performed to safely ensure the retention structure of the deep excavation, and thus, even without installing a separate retention material on the excavation side, there may be no risk of the thumb pile 100 falling or collapsing into the excavation space, and the excavation work may be performed safely and easily at a low cost even in narrow spaces in urban areas.

The preferred embodiments described in the detailed description of the present invention are illustrative and not limiting, and the scope of the present invention is indicated by the appended claims, and all modifications that fall within the meaning of the claims are included in the present invention.

What is claimed is:

1. A provisional facility for retaining earth using a guide bracket and a ground anchor for stepwise retention during deep excavation, the provisional facility comprising:

multiple thumb piles disposed vertically at predetermined intervals;

a wale disposed across the multiple thumb piles;

a guide bracket installed at a predetermined position of the wale; and a ground anchor having the other side anchored to a ground while a tensile member is wound around the guide bracket, wherein each of the multiple thumb piles is provided as any one of a section steel and a steel pipe, the wale is provided as any one of a section steel and a steel pipe, and the guide bracket comprises:

a support plate having a certain thickness and width;

a vertical plate extending at a right angle from each of both ends of the support plate;

a horizontal plate extending at a right angle to the vertical plate;

a semicircular fixed pulley coupled between the vertical plates, wherein the tensile member exposed on a rear surface of the wale is wound around the semicircular fixed pulley and then guided to a groove between the vertical plates so as to be anchored to the support plate on a front surface of the wale.

2. The provisional facility of claim 1, wherein the ground anchor comprises:

an anchor body having a certain weight, which is disposed at a lower end thereof; and a tensile member having one side embedded into the anchor body and the other side drawn to a certain length.

3. The provisional facility of claim 2, wherein an upper free length portion of the tensile member to be fixed to the guide bracket is configured to define a bored position accurately when boring vertically an initial ground anchor-so that an upper portion of the tensile member is exposed when excavated at an installation height of the wale by using excavation equipment, and the tensile member to be fixed to the guide bracket for each stage of excavation is divided to be installed in form of a colored unboard for easy identification so as to be fixed to the wale and the guide bracket for each stage of excavation, thereby providing a retention construction during the deep excavation.

4. A method for constructing a provisional facility for retaining earth by using a ground anchor and a guide bracket for stepwise retention during deep excavation, which is constituted by: multiple thumb piles disposed vertically at predetermined intervals; a wale disposed across the multiple thumb piles; a guide bracket installed at a predetermined position of the wale; and a ground anchor having the other side anchored to a ground while a tensile member is wound around the guide bracket, wherein each of the multiple thumb piles is provided as any one of a section steel and a steel pipe, the wale is provided as any one of a section steel and a steel pipe, and the guide bracket comprises: a support plate having a certain thickness and width; a vertical plate extending at a right angle from each of both ends of the support plate; a horizontal plate extending at a right angle to the vertical plate; a semicircular fixed pulley coupled between the vertical plates, wherein the tensile member exposed on a rear surface of the wale is wound around the semicircular fixed pulley and then guided to a groove between the vertical plates so as to be anchored to the support plate on a front surface of the wale, the method comprising:

forming multiple bored holes by excavating the ground at a predetermined diameter and a predetermined depth;

installing the thumb piles in the bored holes;

installing multiple vertical ground anchors on a rear surface of the wale between the installed thumb piles;

installing the wale to which the guide bracket is attached, across the thumb piles, on the thumb piles;

fixing the tensile member-installed on the ground anchor to the guide brackets;

tensioning the tensile member at a predetermined tension to apply a load to a rear-side ground to a middle portion of the wale; and installing the wale, to which the guide bracket is attached for the stepwise retention during the deep excavation, fixing the tensile member installed on the multiple ground anchors to the guide bracket, and tensioning the tensile member at certain tensile force to transfer a load transferred to the wale to the multiple thumb piles.

5. The method of claim 4, wherein the ground anchor is installed vertically in the same direction as the thumb piles.

6. The method of claim 5, wherein the ground anchor is installed at a position deeper than a ground action line of the rear-side ground of the thumb piles.

7. The method of claim 4, wherein the wale is provided in several stages as an excavation depth increases, and as the number of stages of the wale increases, a diameter and length of an anchorage of the ground anchor become larger and longer.

* * * * *